United States Patent [19]

Thompson

[11] Patent Number: 4,860,187

[45] Date of Patent: Aug. 22, 1989

[54] MAGNETIC FLUX COUPLED VOLTAGE MULTIPLICATION APPARATUS

[75] Inventor: Chester C. Thompson, Roslyn Heights, N.Y.

[73] Assignee: Radiation Dynamics, Inc., Melville, N.Y.

[21] Appl. No.: 240,592

[22] Filed: Sep. 6, 1988

Related U.S. Application Data

[63] Continuation-in-part of Ser. No. 142,695, Jan. 11, 1988.

[51] Int. Cl.[4] ..... H02M 7/10

[52] U.S. Cl. ..... 363/61; 363/68; 336/94; 336/170

[58] Field of Search ..... 363/59, 60, 61, 68, 363/126; 323/361; 336/90, 92, 94, 170, 174, 175

[56] References Cited

U.S. PATENT DOCUMENTS

| | | | |
|---|---|---|---|
| 1,907,633 | 5/1933 | Westermann | 361/270 |
| 2,113,421 | 4/1938 | Camilli et al. | 336/58 |
| 2,251,373 | 8/1941 | Olsson | 336/70 |
| 3,028,569 | 4/1962 | Camilli et al. | 336/70 |
| 3,356,931 | 12/1967 | Welty et al. | 323/361 |
| 3,593,114 | 7/1971 | Pierson | 336/175 |
| 3,611,232 | 5/1971 | Sakamoto | 336/170 |
| 3,708,740 | 9/1973 | Pierson | 363/61 |
| 3,723,846 | 3/1973 | Thompson | 363/61 |
| 3,781,639 | 12/1973 | Peschel | 363/61 |
| 3,889,175 | 6/1975 | Isogai | 363/68 |
| 4,309,747 | 1/1982 | Thompson | 363/61 |
| 4,329,674 | 5/1982 | Hamano | 336/92 |
| 4,338,657 | 7/1982 | Lisin | 363/68 |

*Primary Examiner*—Peter S. Wong

*Attorney, Agent, or Firm*—Shlesinger & Myers

[57] ABSTRACT

An apparatus for producing a very high DC potential output from an AC input. Multiple secondary circuits, each comprised of an individual coil wound about a separate magnetic core, are positioned within the magnetic field of a single primary coil. The output of each secondary circuit is rectified. The output of all secondary circuits is combined in series to provide the high DC potential. The seconary cores are supplied in parallel from the magnetic flux of the primary coil. The primary core and coil form an essentially cylindrical shell, with the secondary cores and coils located within the cylinder interior.

18 Claims, 2 Drawing Sheets

MAGNETIC FLUX COUPLED VOLTAGE MULTIPLICATION APPARATUS

RELATED APPLICATIONS

This application is a continuation-in-part of U.S. application Ser. No. 142,695, filed Jan. 11, 1988, entitled "Magnetic Flux Coupled Voltage Multiplication Apparatus".

BACKGROUND OF THE INVENTION

The present invention relates to high voltage power supplies. More specifically, the present invention relates to high voltage power supplies utilizing a voltage multiplication technique to create a voltage potential of sufficient magnitude for use in an electron accelerator.

Very high potential power supplies in the range of one to two megavolts (MV) are required for a number of applications including high power electron beam accelerators. Beam accelerators in the range of 50–500 kilowatts often require acceleration energies of up to 5 megavolts. Often a large number of power supplies are needed in order to achieve the necessary power to produce the desired electron beam energy. Utilization of a large number of power supplies to achieve such power is often unmanageable and uneconomical.

Presently available accelerators, therefore, do not meet the requirements of high beam power, high beam energy and economical costs. Some commercial power supplies utilized to achieve high voltage energy utilize solid dielectric insulation. Some of these power supplies are able to achieve the necessary high voltage with a few stages but are still not capable of producing the necessary power at an economical cost.

U.S. Pat. Nos. 3,708,740 and 3,393,114 to Pierson teach transformers which are designed to generate large DC potentials. U.S. Pat. No. 2,251,373 to Olsson teaches a high tension transformer having a construction similar to that of the pierson transformers. A number of serially connected coils are positioned proximate a single low voltage coil, thereby magnetically flux coupling the coils to increase the transformer load capacity.

U.S. Pat. No. 4,329,674 to Hamano teaches the combination of three transformers to form a single high voltage transformer, designed to provide a high DC voltage output. U.S. Pat. No. 1,907,633 to Westermann also teaches a means for the cascade connection of a series of transformers.

A commonly utilized high voltage source is the Cockcroft-Walton type power supply. The Cockcroft-Walton supply utilizes series fed electrostatic coupled voltage multipliers which require large capacitance for coupling between stages. Alternatively, an Insulated Core Transformer (ICT) power supply can be utilized to provide the necessary high power requirements. However, ICTs require extremely large magnetic cores to reduce the effects of leakage flux between stages.

SUMMARY OF THE INVENTION

The present invention is a high power, high voltage source similar in construction to a transformer having a single primary winding and multiple secondary windings, spaced from the primary by an inert gas filled region. Principally, this invention provides apparatus to achieve a unique concept for a voltage converter, namely parallel excitation for either DC or AC employing a common primary core and multiple secondary cores connected in parallel. The device has a primary core and a separate secondary core for each of the secondary windings. The primary circuit supplies the necessary magnetomotive force to generate the magnetic flux necessary to feed the secondary coils across the gas gap between the cores.

In direct current applications, the voltage from each of the secondary windings is independently rectified, and the DC voltages produced by the secondaries are connected in series. The total voltage generated by the power source is therefore determined as the sum of the voltages of each of the independent secondary circuits.

The primary coil is preferably arranged in a cylindrical configuration, wherein the secondary coils are located within the cylinder and oriented transverse to the central axis thereof. The secondary is appropriately gapped from the primary and the intervening space filled with inert gas to prevent DC high voltage sparking. Each of the multiple secondary circuits employs a semi-cylindrically shaped magnetic core material for optimizing the flux coupling from the primary.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF PREFERRED EXEMPLARY EMBODIMENTS

Figure 1:
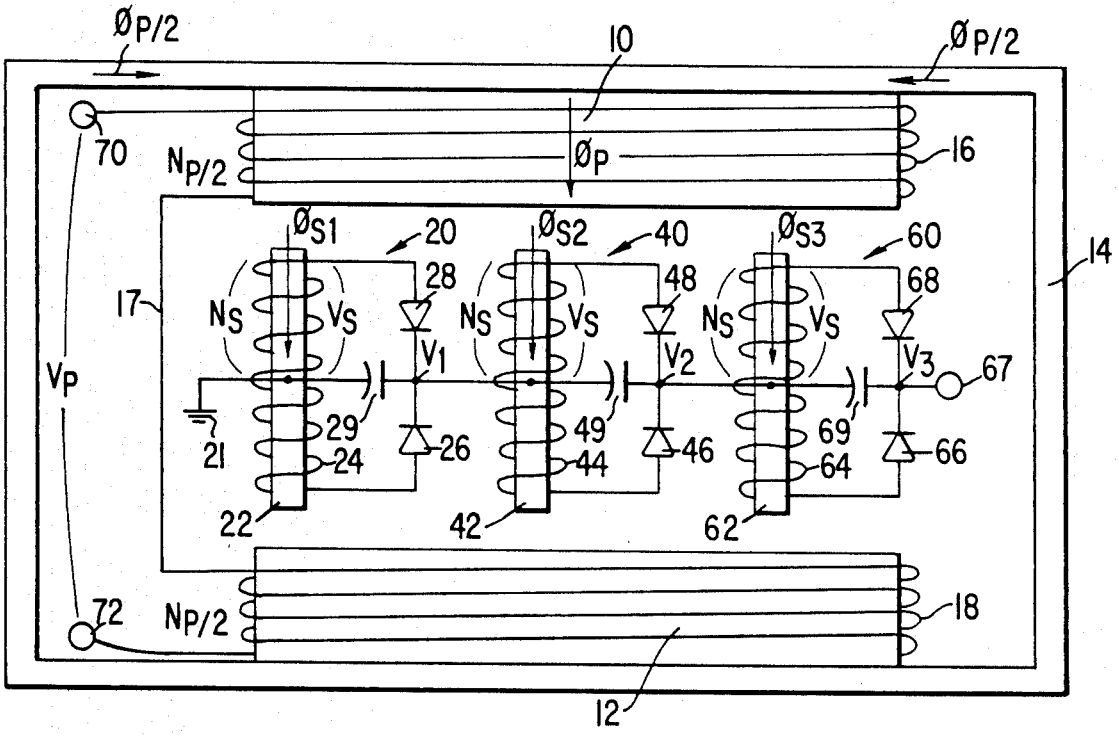
FIG. 1. is a schematic diagram illustrating an implementation of the present invention utilizing center-tapped secondary windings.

The present invention, as illustrated in FIGS. 1–4, is comprised of a primary magnetic core with two poles divided into two halves each half comprising one of two poles, 10 and 12. The two poles 10 and 12 of the primary core are fluxed-linked via vessel 14 or an additional laminated magnetic yoke positioned adjacent to but inside the vessel wall which provides a continuous magnetic flux path. A first half 16 and a second half 18 of a primary winding are wound about each pole 10 and 12, respectively and are connected in series via a lead 17. A separate secondary core is provided for each secondary winding.

Figure 2:
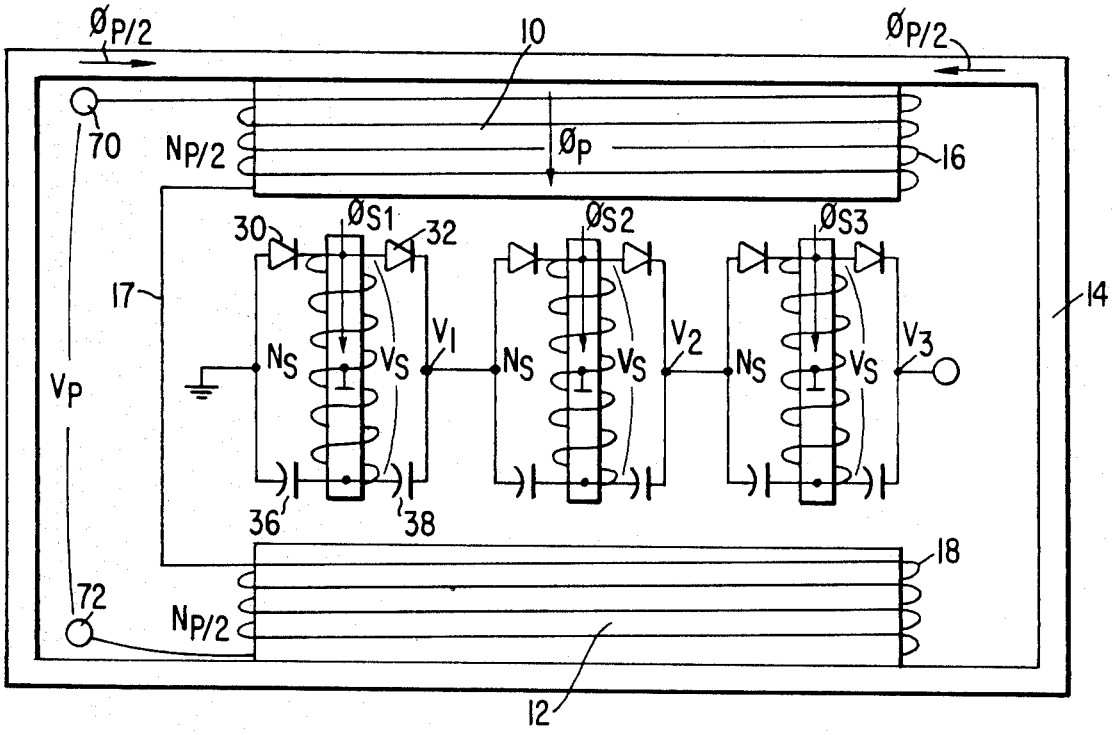
FIG. 2 is a schematic diagram illustrating an implementation of the present invention utilizing a voltage doubler circuit for each secondary stage.
Figure 3:
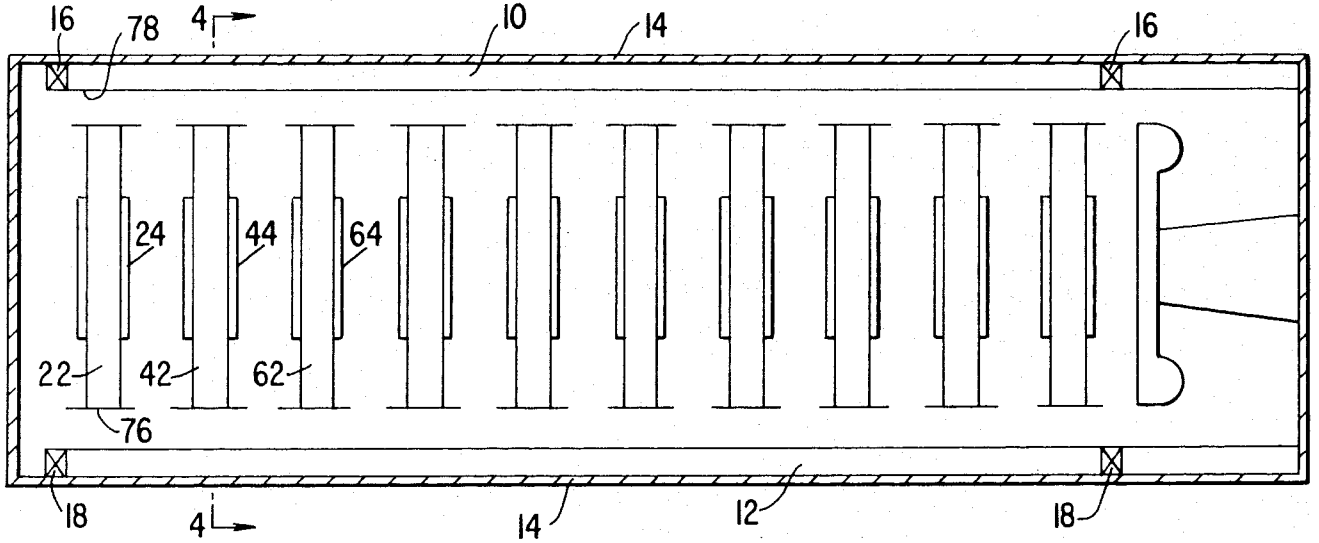
FIG. 3. a cross-sectional side view of a power supply constructed in accordance with the teachings of the present invention.

In FIGS. 1 and 2, three secondary coils and cores are illustrated for the sake of example. In FIG. 3, ten secondary cores and windings are illustrated for sake of example. The voltage generator of the present invention can have any number of secondary cores and windings as is necessary for the particular application of the device. The total voltage produced will be a function of the number of cores and independent windings as well as the number of turns of each winding.

If each of the secondary windings are of equivalent voltage, the total voltage of the device having n number of secondary coils will be n times the voltage per coil. If the voltage of each secondary coil is different, the total voltage will be arrived at as a summation of the voltages of each secondary coil circuit. If a voltage multiplication circuit such as that illustrated in FIG. 2 is utilized in each or selected stages, the total voltage will be increased as the voltage of each circuit is increased. In the specific example of FIG. 2, a voltage doubler rectifier circuit is utilized to increase the voltage from each coil by a factor of two.

The secondary circuits such as circuit 20 for example, are comprised of a secondary core element 22, a coil 24 wound about the secondary core element 22, and appropriate components to convert the AC voltage of the coil into a DC voltage. The conversion elements can be comprised of rectifiers such as 26 and 28 illustrated in FIG. 1, or 30 and 32 as illustrated in FIG. 2 combined, respectively with capacitor 29 or capacitors 36 and 38, as necessary. The output voltages of each secondary circuit are connected in series, one end 21 of the series being grounded and the opposite end utilized as the high voltage DC output potential 67. Either the positive or negative potential can be grounded depending upon the use of the power supply in either a positive or negative system, the opposite potential would then become the high voltage potential output.

A common value for the input voltage $V_p$ is 480 Volts in the U.S. however, the voltage supplied to the present invention is variable to allow for producing variable values of DC output. The value of $V_p$ supplied to the present invention can be varied by any acceptable means such as a variable transformer between the line and the input of the present invention. Each secondary circuit or stage of the present invention can typically provide 10 to 100 Kilovolts (kV). These values are within the manageable range of voltages allowing for secondary insulation and not providing excess stored energy per stage. Therefore, to provide a typical 2 megavolts (MV) to an accelerator, between 20 and 200 stages would be necessary. The present invention accommodates as many or as few stages as needed or desired to provide adequate voltage for the intended application.

The capacitance as illustrated for example by capacitor 29 in FIG. 1, is not strictly necessary for the production of the high voltage potential but may be required for filtering. The value of the capacitance needed is determined by the following formula:

$$C = 100It \div nV \text{ per phase per circuit,}$$

where:

I = the DC average current in anperes n = the percent peak to peak ripple, v = the DC circuit voltage in volts t = time period from one rectification interval to the next in seconds and c = the capacitance in microfarads.

Describing the apparatus illustrated in FIG. 1 in greater detail, there are three secondary circuits, 20, 40 and 60, illustrated. Again, any number of secondary circuits can be provided with each additional circuit readily connected in series with the existing circuits. A voltage $V_p$ is supplied across primary input terminals 70 and 72. Voltage $V_p$ is an alternating current source of sufficient magnitude to create the necessary magnetomotive force to supply the secondary circuits of the voltage generator. The voltage $V_p$ is supplied to the primary coil comprised of the two coil halves 16 and 18 each made up of a number of turns $N_{p/2}$. The total number of turns for the primary coil being $N_p$, i.e., the sum of the number of turns in each of the coil paths 16 and 18.

The alternating current flowing through the primary coil creates a magnetic flux flow $\Phi_P$ as indicated by the arrow in FIG. 1. Some of this total magnetic flux flows in parallel through the secondary cores 22, 42 and 62 in amounts $\Phi_{S1z}$, $\Phi_{S2}$ and $\Phi_{S3}$, as illustrated by arrows in FIG. 1. For equivalent secondary circuits 20, 40 and 60, $\Phi_{S1}$, $\Phi_{S2}$ and $\Phi_{S3}$ should be equivalent also. The return path for the magnetic flux is through the vessel wall 14, or an internal magnetic yoke, as indicated by the arrows $\Phi_{P/2}$ in FIGS. 1 and 3.

The magnetic flux $\Phi_S$ in each of the cores 22, 42 and 62 creates an alternating voltage in each of the coils 24, 44 and 64 respectively. In a direct current application the voltage in each of these coils is then rectified to DC -nd connected in series as illustrated. The high DC voltage potential between 21 and 67, is thereby obtained through the parallel coupling of magnetic flux to each of the cores and the series cascade connection of the rectified output of each of the coils.

As illustrated in the figures, the secondary cores and circuits are gapped from the primary core and circuit. This gap, 74, as best illustrated in FIG. 4, is filled with a high pressure insulating inert gas and provides the necessary DC insulation to prevent DC arcing and circuit breakdown.

Figure 4:
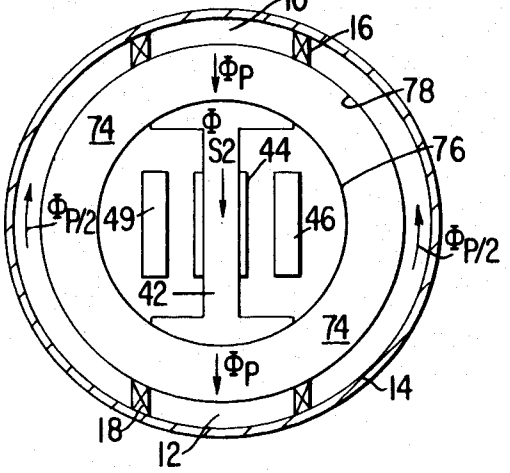
FIG. 4. is, a cross-sectional view of the transformer of FIG. 3 taken along line 4—4.

The secondary core 42, as illustrated in FIG. 4, is semi-cylindrical in cross-section in order that the outer surface will conform to the cylindrical shape of the primary core. The matching of shapes including shapes other than cylindrical allows for a uniform air gap. The air gap 74 is designed as a minimum distance to maintain the leakage flux at a minimum but at the distance necessary to prevent sparking.

The arrangement of secondary circuits illustrated in FIG. 2 allows for effective doubling of the DC voltage tapped from each secondary coil.

As is conventional in voltage doublers, the secondary coils of FIG. 2 have two pairs of capacitors and diodes connected in series across each coil with the diodes oppositely poled to charge each capacitor to the full voltage across the coil during opposite phases. The capacitors are connected in series to the output load, thus doubling the output voltage.

outer cylinder 76 and inner cylinder 78 are nonmagnetic, metallic cylinders which provide electrostatic shielding. Since high voltage appears between the two cylinders it is important to provide smooth continuous surfaces to prevent corona or DC voltage breakdown.

The air gap 74 in conjunction with cylinders 76 and 78 and the size and diameter of each is determined by the maximum electrostatic field and the dielectric strength of the insulating medium to prevent voltage breakdown.

Because the voltage generator of the present invention is parallel fed rather than series fed it provides for a much greater simplicity of design to achieve different energy or power levels. Higher voltage outputs are obtained simply by adding stages, increasing the gas gap spacing and/or changing the diameters of the secondary and primary circuits as well as through voltage multiplying methods.

The adaptations of the structure of the present invention must conform with the maximum allowable voltage stress limits for concentric cylinder geometry. The current is increased through increasing the size of the magnetic circuits, rectifiers and/or filter capacitors as necessary. Also the voltage generator of the present invention can be optimized in overall size and weight through the increasing of the frequency of the operating current. This will allow for decrease in the size and weight of the magnetic materials and reduce the stored energy while increasing the energy output. There is, however, a tradeoff in increased eddy current and hysteresis losses through the increase in the operating frequency. These losses can be compensated for through utilization of superior core materials and construction techniques in order to maintain high power efficiencies. The improved construction techniques may include a magnetic yoke of laminated core material lining the vessel wall thereby substantially eliminated coupling of flux to the housing which is quite lousy due to its non-laminated construction and choice of material required for strength.

Figure 6:
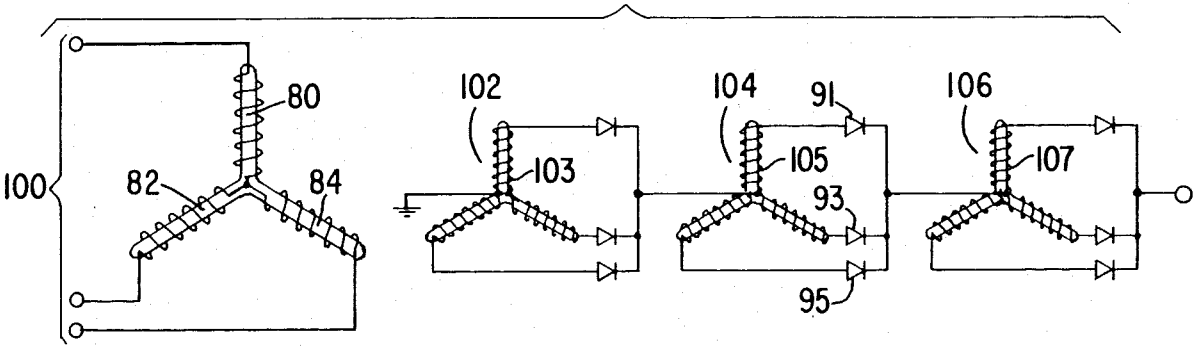
FIG. 6. is a schematic representation of the voltage generator illustrated in FIG. 5.
Figure 5:
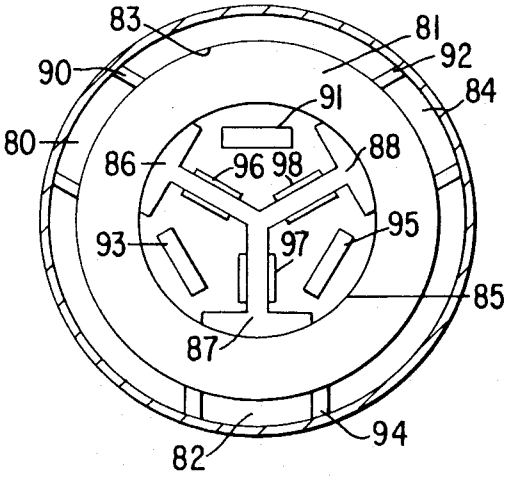
FIG. 5. is a cross-sectional end view of a three-phase voltage generator constructed in accordance with the teachings of the present invention.

FIGS. 5 and 6 illustrate an embodiment of the present invention configured for three phase power operation. The primary magnetic core is divided into three sections 80, 82 and 84 surrounded by the primary coil sections 90, 92 and 94. Each secondary core is correspondingly divided into three sections 86, 87 and 88 with coils 96, 97 and 98, respectively. The three phase power generator is provided with a gas gap 81 and electrostatic shielding 83 and 85. Three rectifiers 91, 93 and 95 are provided for each secondary for conversion of the three phase output of each secondary to DC. Other forms of conversion can be utilized as desired; for example, a full wave, three phase bridge rectifier circuit employing six rectifiers per stage.

As three phase power is provided to terminals 100 a magnetic flux is generated in primary core segments 80, 82 and 84, inducing flux in secondary cores 102, 104 and 106, generating current in secondary coils 103, 105 and 107. The total output of the voltage generator is the sum of the rectified outputs of each of the secondary coils.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

Once given the above disclosure, many other features, modifications and improvements will become apparent to the skilled artisan. Such features, modifications and improvements are thus to be considered a part of this invention, the scope of which is to be determined by the following claims:

What is claimed is:

1. A voltage converter, comprising;

a primary electromagnetic circuit, said primary circuit including a primary magnetic core, a first secondary electromagnetic circuit, said first secondary circuit including a first secondary magnetic core, said primary core defining two arc segments supported within a housing, and said first secondary core lying within said housing, means for connecting said primary circuit to a supply of alternating current, and a first rectification circuit connected to said first secondary circuit, wherein when alternating current is connected to said primary circuit, a first magnetic field is established, said first secondary circuit being positioned such that said first magnetic field induces a current flow in said first secondary circuit.

2. The voltage converter of claim 1, further comprising;

a second secondary electromagnetic circuit adjacent said first secondary circuit, within said housing, and a second rectification circuit connected to said second secondary circuit, wherein a current flow is induced in said second secondary circuit simultaneously with said current flow in said first secondary circuit.

3. The voltage converter of claim 2, wherein said first and second rectification circuits are connected in electrical series.

4. A voltage converter, comprising;

a housing having a central axis, a first elongated pole element supported within said housing, a second elongated pole element supported within said housing opposite said first pole element, wherein the elongated axes of each of said poles extending parallel to the central axis of said housing, a plurality of core elements positioned within said housing between said poles and spaced along said housing axis, a drive coil wound about each of said poles, means for applying alternating current to said drive coil, an inductance coil surrounding each of said core elements, wherein said inductive coils are connected in series.

5. The voltage converter of claim 4, wherein each of said core elements is comprised of a pair of radial arms extending from said central axis along a common diameter of said housing toward said pole elements.

6. The voltage converter of claim 4, further comprising;

a third elongated pole element wherein said pole elements are equally spaced about the perimeter of said housing, and each of said core elements is comprised of three radial arms extending from the central axis of said housing toward said pole elements.

7. The voltage converter of claim 4, or claim 6 wherein said drive coil and said poles create a magnetic field, and said core elements are exposed, in parallel, to said magnetic field.

8. The voltage converter of claim 5 or claim 6, wherein each of said pole elements has an essentially crescent shaped cross-section, each of said arms having a terminal portion adjacent one of said pole elements, and said terminal portions having an essentially crescent shaped cross-section, the surface of said terminal portion being consistently spaced from the surface of said pole element.

9. A voltage converter, comprising;

a first cylindrical housing having an outer surface and an inner surface, at least two pole elements adjacent said inner surface, at least one core member located along the central axis of said housing and spaced from said pole elements by an isolating gap, a first cylindrical shield separating said pole elements from said isolating gap, and a second cylindrical shield separating said core member from said isolating gap.

10. A voltage converter according to claim 1 further comprising a primary coil and a secondary coil and where the first magnetic field induces a magnetic flux in said secondary core.

11. A voltage converter according to claim 2 further including n rectification circuits connected in series wherein 2.

12. A voltage converter according to claim 4 including a rectifier circuit interposed between each of the coils.

13. A voltage supply for alternating or direct current, comprising;

a primary electromagnetic circuit, said primary circuit including a primary magnetic core;

a first secondary electromagnetic circuit, said first secondary circuit including a first secondary magnetic core, said primary core defining two arc segments supported within a housing, and said first secondary core lying within said housing, and means for connecting said primary circuit to a supply of current, wherein when current supply is connected to said primary circuit, a first magnetic field is established, said first magnetic field inducing a current flow in said first secondary circuit.

14. The voltage supply of claim 13, further comprising;

a second secondary electromagnetic circuit adjacent said first secondary circuit, within said housing, and wherein a current flow is induced in said second secondary circuit simultaneously with said current flow in said first secondary circuit.

15. The voltage supply of claim 14, wherein the voltages developed by said first and second circuits are connected in series.

16. The voltage supply of claim 14 wherein said currents are in phase

17. The voltage supply of claim 15 where said first and second circuits are rectification circuits for production of DC current.

18. A high voltage power supply including a primary coil and primary magnetic core defining two arc segments, a plurality of secondary coils and secondary cores contained within said arc segments and connected in parallel and means for providing a supply of current to said primary coil, where a magnetic field is induced from said primary core upon supplyigg current to said primary coil which induces a current flow in said secondary coils.

* * * * *